US007252213B1

(12) United States Patent
DeSanto

(10) Patent No.: US 7,252,213 B1
(45) Date of Patent: Aug. 7, 2007

(54) BEVERAGE JUG COVER

(76) Inventor: David F. DeSanto, 4049 Weeping Willow Dr., Moorpark, CA (US) 93021

( * ) Notice: Subject to any disclaimer, the term of this patent is extended or adjusted under 35 U.S.C. 154(b) by 108 days.

(21) Appl. No.: 11/141,780

(22) Filed: May 31, 2005

(51) Int. Cl.
*A45F 5/00* (2006.01)
*B65D 23/08* (2006.01)

(52) U.S. Cl. ..... 224/148.7; 224/148.4

(58) Field of Classification Search ..... 224/148.1, 224/148.2, 148.3, 148.4, 148.5, 148.6, 148.7; 215/396; 220/737, 739; 150/901
See application file for complete search history.

(56) References Cited

U.S. PATENT DOCUMENTS 2,464,069 A * 3/1949 Benson ..... 206/466
4,468,933 A * 9/1984 Christopher ..... 62/457.1
5,354,131 A 10/1994 Mogil
5,356,046 A 10/1994 Burke
5,415,305 A 5/1995 Drake-Tipton
5,931,583 A 8/1999 Collie
5,954,238 A * 9/1999 Rausch ..... 222/158
5,988,879 A 11/1999 Bredderman
6,062,434 A 5/2000 Melk
6,073,796 A 6/2000 Mogil
6,276,579 B1 * 8/2001 DeLoach ..... 224/148.3
6,401,993 B1 6/2002 Andrino
2003/0106895 A1 6/2003 Kalal

* cited by examiner

*Primary Examiner*—Nathan J. Newhouse
*Assistant Examiner*—Corey N. Skurdal
(74) *Attorney, Agent, or Firm*—Jack C. Munro; Sandy Lipkin

(57) ABSTRACT

A beverage jug cover which is constructed of flexible material and has an internal compartment within which is to be located the beverage jug. A section of gatherable material (usually of fabric) surrounds an access opening into the internal compartment with there being a drawstring mounted within the section of gatherable material and by pulling of the drawstring the gatherable material can be made to occupy a tight position with the neck of the beverage jug. The beverage jug cover includes a thermal insulation layer which is mounted within the sidewall of the internal compartment. There is also formed a pair of handle access openings within the cover which connect with the handle of the jug to facilitate carrying of the jug using the handle of the jug.

5 Claims, 4 Drawing Sheets

BEVERAGE JUG COVER

BACKGROUND OF THE INVENTION

1. Field of the Invention

This invention relates generally to carryable beverage jugs and more particularly to a cover for a beverage jug which is designed to keep the contents of the beverage jug cool for as long as possible or, if heated, hot for as long as possible.

2. Description of the Related Art

It has always been a challenge to attempt to maintain the temperature of a beverage when that temperature is different from the ambient environment. There has long been constructed thermally insulative containers which are used by humans when a refrigerator is not convenient or when a heat source is not convenient. The beverage container is to be surrounded by a thermally insulative material in an effort to keep a cold beverage cold or to keep a hot beverage hot. Most thermally insulated containers are constructed of a hard plastic foam and are designed to contain ice with the beverages that are to be maintained cool to be placed therein. Hot beverages can also be placed in such thermally insulative containers with, of course, the ice not being used.

There has also been constructed flexible walled thermally insulative containers. These flexible walled thermally insulative containers are normally constructed of fabric. These fabric covers are then to be placed about the wall surface of a beverage container. In the past, such covers have not been designed to include multiple features that facilitate easy portability of a beverage jug and are not constructed to be durable over a long period of time.

SUMMARY OF THE INVENTION

The basic embodiment of beverage jug cover of the present invention utilizes a body constructed of a flexible material with the body having an internal compartment. A beverage jug is adapted to be located within the internal compartment. The body includes an access opening with the neck of the beverage jug to be located in conjunction with the access opening. A section of gatherable fabric material is mounted on the body surrounding the access opening. A drawstring is mounted within this section directly adjacent the access opening. Manually pulling on the drawstring is to cause the gatherable fabric material to become tight against the neck of the beverage jug. A thermal insulation layer is attached to the body and connects with the internal compartment. A pair of handle access openings are formed within the body with the handle access openings adapted to connect with the jug handle to permit access to the jug handle to facilitate manual carrying of the beverage jug, the access openings being apertures cut along both sides of the handle and in the same direction as the handle. There is also a strip of material integral with the body located between the handle access openings, the strip of material to be aligned with the jug handle. A securing strap binds the strip of material to the jug handle.

A further embodiment of the present invention is where the first basic embodiment is modified by defining a support strap that goes entirely across the body and is secured by an encircling band located directly adjacent the gatherable fabric material.

A further embodiment of the present invention is where the just previous embodiment is modified by defining that there is a shoulder strap mounted in conjunction with the cover with the shoulder strap being integral with the support strap.

A further embodiment of the present invention is where the first basic embodiment is modified by defining that there is a carryable handle mounted on the body of the cover.

A further embodiment of the present invention is where the first basic embodiment is modified by defining that there is an article containing pocket mounted on the body.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
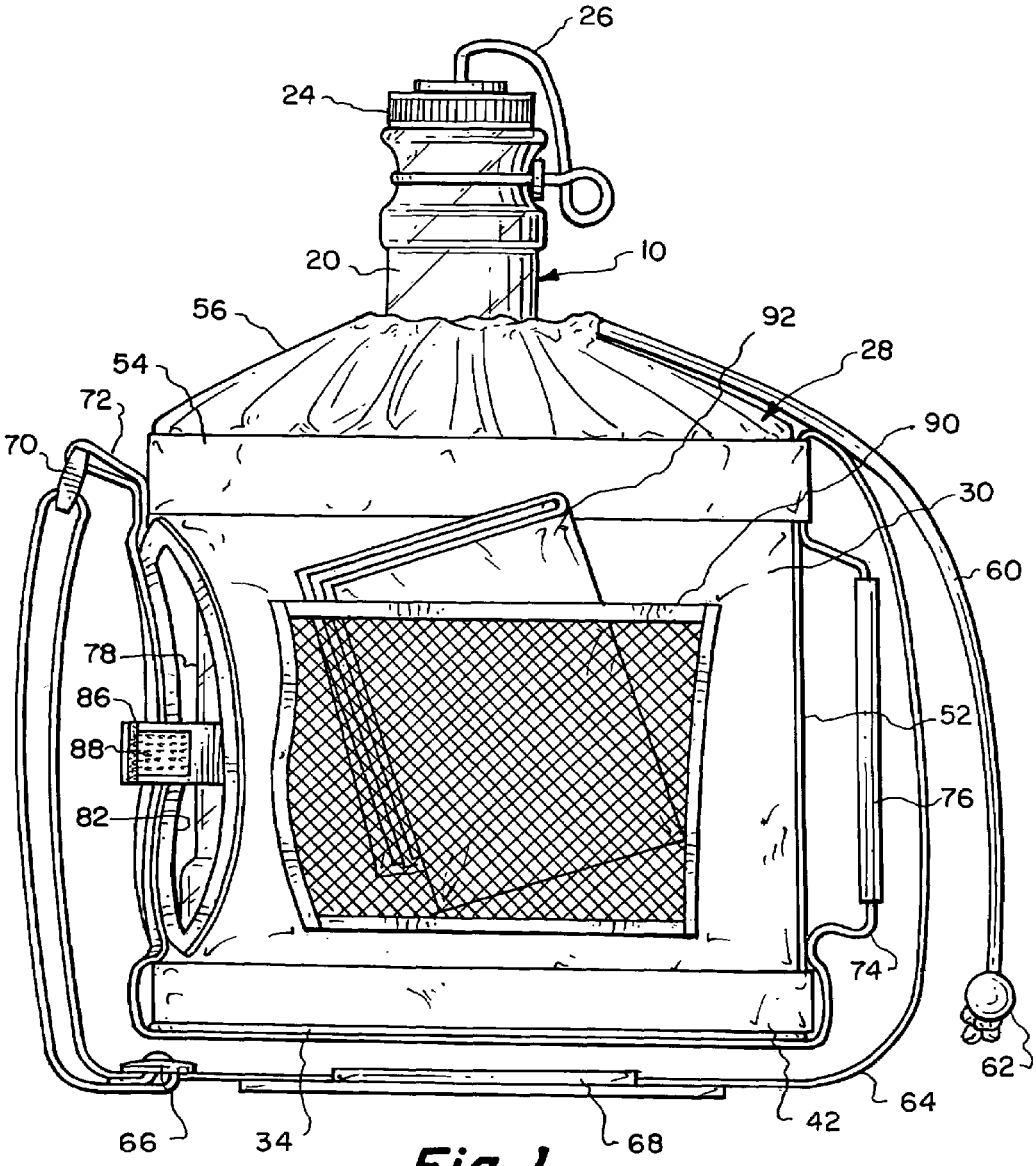
FIG. 1 is a front elevational view of the beverage jug cover of the present invention showing such being mounted in conjunction with a typical beverage jug.
Figure 2:
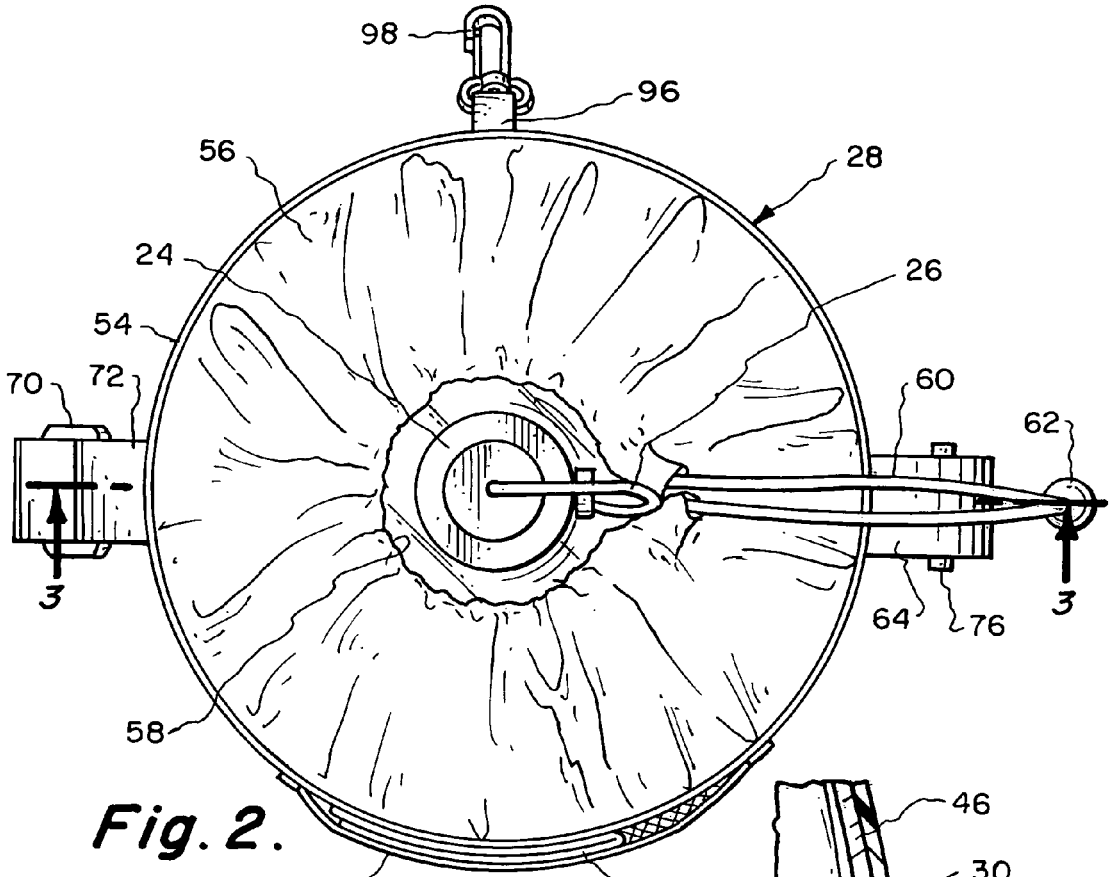
FIG. 2 is a top plan view of the beverage jug cover of the present invention showing such as it is mounted in conjunction with a beverage jug.
Figure 4:
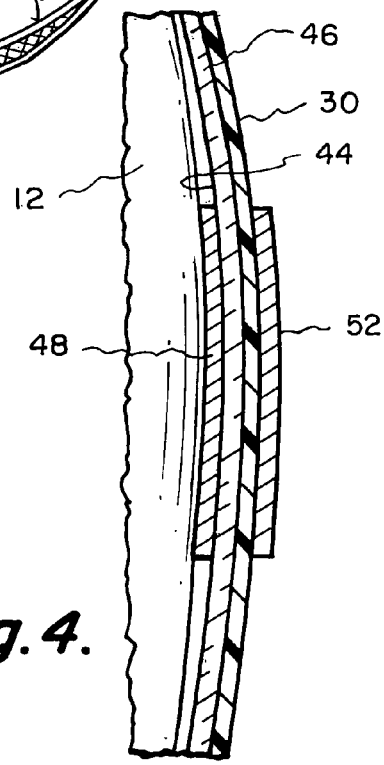
FIG. 4 is an enlarged cross-sectional view taken through a portion of the sidewall of the beverage jug cover of the present invention taken along line 4-4 of FIG. 3.
Figure 3:
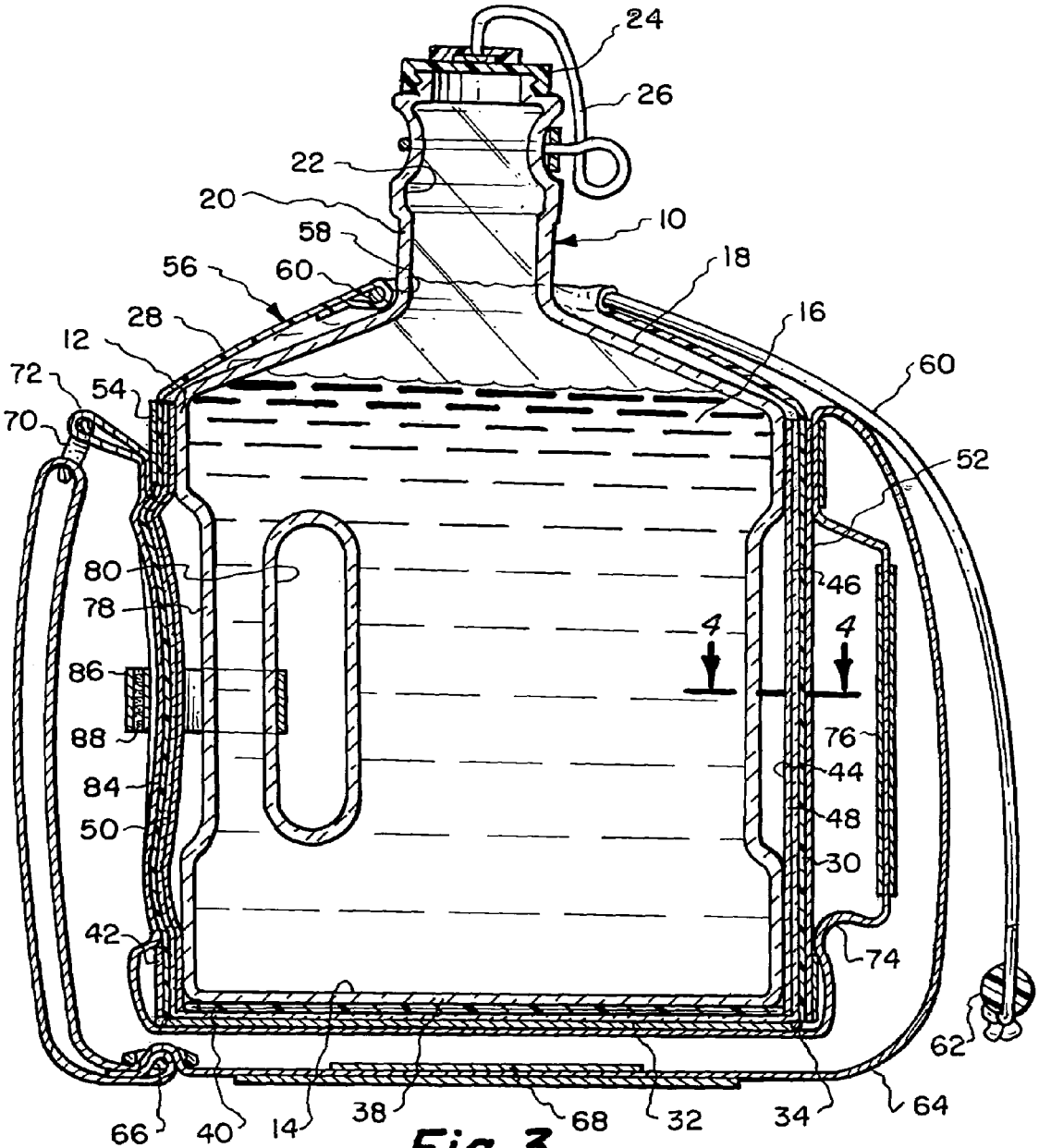
FIG. 3 is a cross-sectional view taken along line 3-3 of FIG. 2 showing in detail the internal construction of the beverage jug cover of the present invention.
Figure 5:
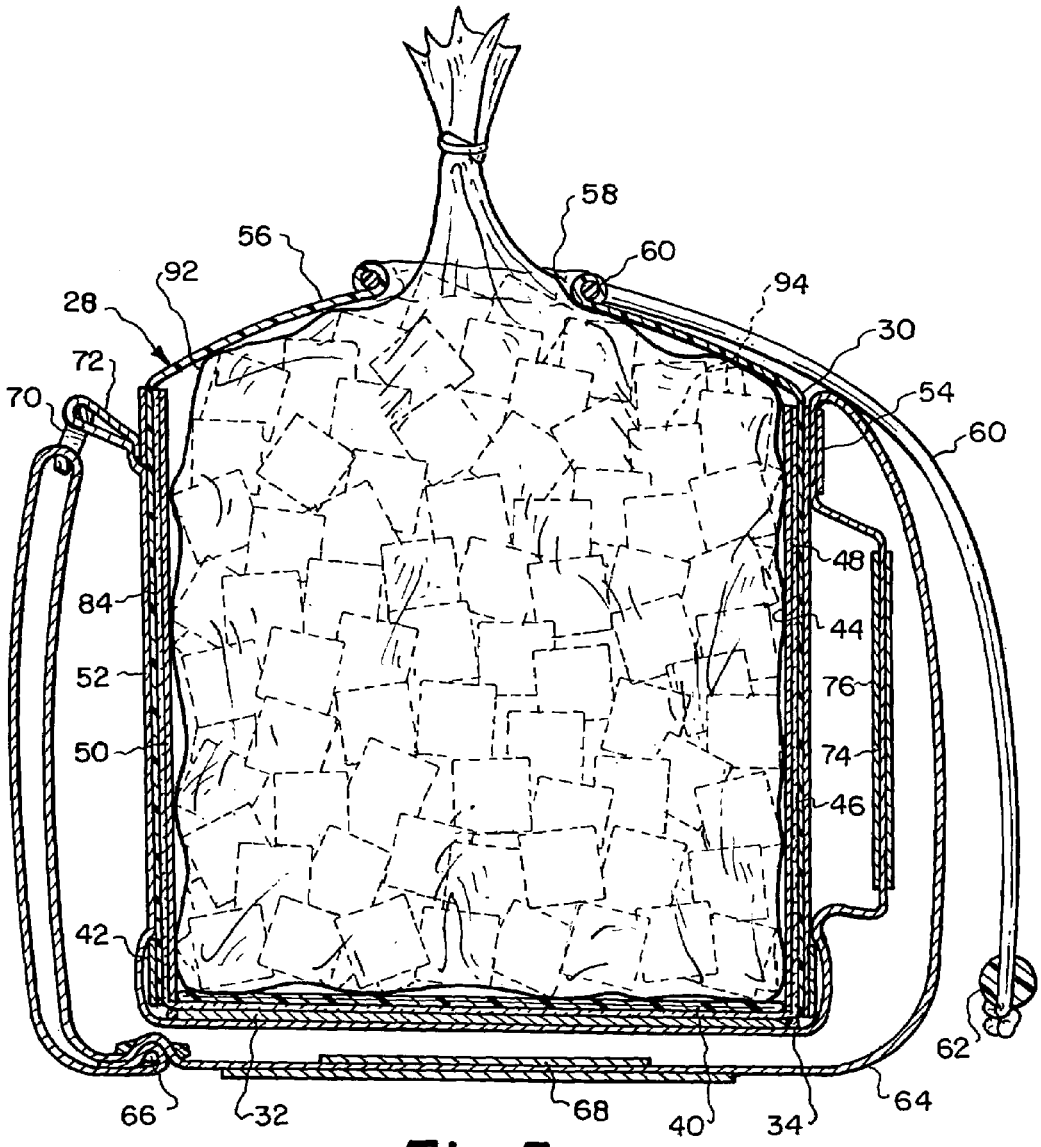
FIG. 5 is a cross-sectional view similar to FIG. 3 but showing the beverage jug cover being removed and a plastic bag inserted within the internal compartment of the cover with the plastic bag to be utilized to contain ice.

Referring particularly to the drawings, there is a shown a beverage jug 10 which has an enlarged body 12 within which is located a liquid containing chamber 14. Typically, the chamber 14 will contain a beverage 16 which can comprise water, fruit juice, soda, et. cetera. The beverage jug 10 includes an inclined annular wall 18 which connects to a neck 20. Passing through the neck 20 is an access passage 22. Mounted on the neck 20 and adapted to close the access passage 22 is a cap 24. The cap 24 is attached to a tether 26 the outer end of which is secured around the neck 20. The cap 24 can be removed to effect pouring the beverage 16 or inserting of the beverage 16 within the liquid containing chamber 14. When the cap 24 is removed, the tether 26 will permit the cap 24 from being misplaced as it will always be connected to the beverage jug 10.

Mounted about the beverage jug 10 is the cover 28 of the present invention. The cover 28 includes a body 30 which is formed of a fabric or other similar sheet material, such as plastic. The body 30 surrounds the enlarged body 12 of the beverage jug 10. The body 30 has mounted thereon a base 32 which generally will be formed of a flexible plastic material. The base 32 includes a circular bead 34 formed at its periphery. The base 32 is to be located directly adjacent the bottom 38 of the beverage jug 10. In between the bottom 38 and the base 32 is a cardboard or plastic protective member 40. The purpose of the protective member 40 is to provide a barrier between the jug 10 and the base 32.

Mounted on the sidewall of the body 30 directly adjacent the base 32 is an annular bottom strip 42. The purpose of the bottom strip 42 is to protect the interconnection between the body 30 and the base 32. Mounted within the internal compartment 44 of the cover 28 is a thermal insulative layer 46. The insulative layer 46 will generally comprise a foam which is encased within a plastic. Mounted on the inside surface of the thermal insulative layer 46 are a pair of diametrically spaced apart support straps 48 and 50. Each support strap 48 and 50 provides support for a seam that is formed within the fabric of the body 30. The seam is actually a sewn seam and is not shown in the drawings as it is deemed to be conventional. Mounted on the outside surface of the body 30 in alignment with the support straps 48 and 50 is a support strap 52. The support strap 52 extends completely along the sidewall of the body 30 and across the base 32. The support strap 52 is attached to an encircling band 54 that is mounted around the body 30 directly adjacent gatherable fabric material 56. The gatherable fabric material 56 includes center opening 58 through which is to extend the neck 20 of the jug 10. Mounted within the gatherable fabric material 56 and located about the center opening 58 is a drawstring 60. Manually drawing tight on the drawstring 60 will cause the gatherable fabric material 56 to be located flush against the inclined annular wall 18 and the center opening 58 will become tight against the neck 20. The gatherable fabric material 56 functions to prevent accidental removal of the jug 10 from the cover 28 and also functions as a thermal barrier to help keep the contents of the jug 10 cold or hot. In order to remove the jug 10 from the cover 28, it would be necessary for the drawstring 60 to be loosened sufficiently to cause the gatherable fabric material 56 to expand to basically become in alignment with the body 30 so as to permit the jug 10 to be extracted from the internal compartment 44. The outer end of the drawstring 60 is mounted on a ball 62 which is to be moved along the string 60 toward the access opening 58 when tightening of the gatherable fabric material 56 relative to the neck 20.

The support strap 52 is integral with the shoulder strap 64. The shoulder strap 64 is to be of a sufficient length as to permit location on top of a shoulder of a human user in order to facilitate carrying of the beverage jug 10 of this invention as well as the cover 28. The shoulder strap 64 is to be adjustable by a buckle 66. The shoulder strap 64 also has mounted thereon a pad 68 which is to provide a soft surface against the shoulder of the human when it is carried. The shoulder strap 64 is mounted by a pivot link 70 to a loop 72. The loop 72 is integral to the support strap 52.

Also integral to the support strap 52 is a carryable handle 74. Mounted on the handle 74 is a pad 76. The function of the pad 76 is to provide a soft surface when using of the handle 74 in order to provide one way in which the jug 10 of this invention can be carried.

Another way that the jug 10 of this invention may be carried is by using the handle 78 of the beverage jug 10. The handle 78 is formed within the sidewall of the jug 10 with there being a cutout opening 80 formed through the wall of the jug 10. The user's fingers are to be extendable through the cutout opening 80 with a grasping motion being applied to the handle 78. In order to permit access into the cutout opening 80, there is included within the body 30 a pair of spaced apart holes 82. Located between the holes 82 is a strip of material 84. The strip 84 is to align with the handle 78. In order to insure that the strip 84 is in continuous alignment with the handle 78, there is utilized a separate securing strap 86 which attaches the strip 84 to the handle 78. The ends of the securing strap 88 can be secured together through the use of hook and eyelet pads 88, which are deemed to be conventional.

Mounted on the exterior surface of the body 30 is an article containing pocket 90. Typically, the pocket 90 will be formed of a netting material. Pocket 90 can be used to support an article, such as a plastic bag 92. The purpose of the plastic bag 92 is to be used within the internal compartment 44 when the jug 10 is removed so that the bag 92 can be used to contain ice cubes 94.

There is also to be mounted on the body 30 a loop 96. Attached to the loop 96 is a hook 98. The hook 98 can be used to secure to an exterior object, such as a towel or some other type of object.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A beverage jug cover comprising:

a body constructed of a flexible material, said body having an internal compartment, a beverage jug adapted to be located within said internal compartment, an access opening formed in said body, whereby a neck of the beverage jug is to be located within said access opening;

a section of gatherable material mounted on said body surrounding said access opening, a drawstring mounted within said section directly adjacent said access opening, manual pulling on said drawstring is to cause said gatherable material to become tight against the neck;

a thermal insulation layer attached to said body and connected with said internal compartment, said thermal insulation layer is to cause the jug to stay cool if it contains cold beverages or stay hot if it contains hot beverages; and a pair of handle access openings formed within said body, said handle access openings being adjacent a jug handle on the jug to permit access to the jug handle to manually carry the jug, said access openings being apertures cut along both sides of said handle and in the same direction as said handle;

a strip of material integral with said body located between said handle access openings, said strip of material to be aligned with said jug handle;

a securing strap to bind said strip of material to said jug handle.

2. The beverage jug cover as defined in claim 1 wherein:

a support strap mounted on said body, said support strap extends entirely across said body, said support strap being secured to said body by an encircling band attached to said body and located directly adjacent said gatherable material.

3. The beverage jug cover as defined in claim 2 wherein:

a shoulder strap mounted on said body, said shoulder strap permitting carrying of the beverage jug and the beverage jug cover by a human user with the shoulder strap being located across a shoulder of the human user, said shoulder strap being integral with said support strap.

4. The beverage jug cover as defined in claim 1 wherein:

a carrying handle mounted on said body, said carryable handle to permit carrying of the beverage jug and the beverage jug cover by a human.

5. The beverage jug cover as defined in claim 1 wherein:

said body including an article containing pocket.

* * * * *